United States Patent [19]

Cosmo

[11] Patent Number: 4,984,413

[45] Date of Patent: Jan. 15, 1991

[54] MACHINE AND METHOD FOR OVERWRAPPING CYLINDRICAL ARTICLES

[75] Inventor: Guy Cosmo, Selden, N.Y.

[73] Assignee: K. C. Technical Services, Inc., Bohemia, N.Y.

[21] Appl. No.: 400,374

[22] Filed: Aug. 30, 1989

Related U.S. Application Data

[63] Continuation-in-part of Ser. No. 342,110, May 22, 1989, Pat. No. 4,945,707.

[51] Int. Cl.[5] ..... B65B 11/56; B65B 11/04

[52] U.S. Cl. ..... 53/465; 53/557; 53/216

[58] Field of Search ..... 53/214, 211, 216, 557, 53/389, 442, 465, 588

[56] References Cited

U.S. PATENT DOCUMENTS

| | | | |
|---|---|---|---|
| 2,938,319 | 5/1960 | Nystand | 53/214 |
| 3,135,078 | 6/1964 | Keene et al. | 53/214 |
| 3,273,301 | 9/1966 | Anderson | 53/214 X |
| 3,659,394 | 5/1972 | Hartleib et al. | 53/216 X |
| 3,881,296 | 5/1975 | Bate | 53/557 X |
| 3,968,622 | 7/1976 | Kataoka | 53/214 X |
| 4,608,807 | 9/1986 | Skripalle | 53/214 X |

*Primary Examiner*—Horace M. Culver

*Attorney, Agent, or Firm*—Collard, Roe & Galgano

[57] ABSTRACT

A machine for wrapping generally cylindrical articles, includes a supply reel rotatably mounted in the machine for unreeling a web of sheet material, a conveyor for transporting the articles along a predetermined path, an inclined infeed table for supplying the articles by means of a gravity feed to the conveyor, and an article infeed mechanism disposed adjacent the infeed table for successively feeding the articles to the conveyor. The articles infeed mechanism is movable between a first position in which it stops the feed of the articles fed thereto and a second position in which the articles are allowed to successively move by gravity forward for deposit on the conveyor. A device is provided for successively adhering the leading edge of the sheet material to the articles and a transverse parting wire serves to sever a predetermined portion of the sheet material so that it may be wrapped around the article as it rolls forward toward the conveyor. A method for wrapping cylindrical articles is also disclosed.

13 Claims, 4 Drawing Sheets

MACHINE AND METHOD FOR OVERWRAPPING CYLINDRICAL ARTICLES

This application is a continuation-in-part of application Ser. No. 342,110 filed May 22, 1989, entitled "MACHINE AND METHOD FOR OVERWRAPPING CYLINDRICAL ARTICLES" which has issued as U.S. Pat. No. 4,945,707 on Aug. 7, 1990.

BACKGROUND OF THE INVENTION

1. Field of the Invention

The invention relates to a machine and method for overwrapping cylindrical or nearly cylindrical articles for packaging or labeling of those articles. More particularly, the invention relates to a machine and method for wrapping wallpaper, giftwrap and facsimile paper rolls.

2. Description of the Prior Art

Machines are known for wrapping articles and, in particular, cylindrical or nearly cylindrical articles. One such commercial machine is disclosed in U.S. Pat. No. 3,659,394. The machine is specifically designed and used for packaging and labeling articles, such as adhesive tape rolls. These adhesive tape rolls vary in size, but they typically are manufactured in widths of between ¼ inch up to 2 to 3 inches.

In my prior co-pending application (Ser. No. 342,110, filed Apr. 24, 1989 now U.S. Pat. No. 4,945,707), an improved machine and method for overwrapping such cylindrical and nearly cylindrical articles is disclosed, which significantly enhances the speed of operation and the reliability thereof. The improved machine affords a stable support for the relatively narrow and unstable tape rolls.

A problem exists with respect to the overwrapping of generally larger cylindrical objects, such as wallpaper rolls, giftwrap rolls, facsimile paper rolls, and the like, which, unlike tape rolls, have a loose trailing edge. Typically, a piece of tape must be manually applied to the trailing edge on the roll to prevent it from unravelling during processing. As can be appreciated, this is both time consuming and expensive.

Consequently, there is a great need for a wrapping machine which would eliminate the need for manually taping the trailing edge of the paper to the remainder of the roll. However, the aforementioned machines are not generally suitable for this purpose since, in the wrapping operation, they effect rotation of the cylindrical article in two different rotational directions. As a result, the roll will start to unwind if its trailing edge is not secured.

SUMMARY OF THE INVENTION

Accordingly, it is an object of the present invention to provide an improved machine for overwrapping cylindrical and nearly cylindrical articles which eliminates the need for taping the trailing edge of the roll, prior to wrapping thereof.

It is also an object of the present invention to provide such a machine which is relatively simple in design, has a high degree of reliability and flexibility, and provides significantly higher speeds of operation.

It is a more particular object of the present invention to eliminate the need for the use of water or glue for effecting the initial retention of the sheet material used as a wrapper to the cylindrical object to be wrapped.

Certain of the foregoing and related objects are readily attained in a machine for wrapping generally cylindrical articles which includes a supply reel rotatably mounted in the machine for unreeling a web of sheet material having a leading edge, conveyor means for transporting the articles along a predetermined path, an inclined infeed table for supplying the articles by means of a gravity feed to the conveyor means, and article feed and restraint means disposed adjacent the infeed table for successively feeding the articles to the conveyor means, movable between a first position, in which it stops the feed of the articles fed successively thereto, and a second position in which the articles are allowed to successively move by gravity forward for deposit on the conveyor means. The machine also includes means for supplying the leading edge of the sheet material between said article feed means and the cylindrical articles, means for successively adhering the leading edge of the sheet material to the articles, and transverse cutting means operatively acting with the article feed means for severing a predetermined portion of the sheet material so that the predetermined portion may be wrapped around each of the articles as they roll forward toward the conveyor means.

Preferably, the machine additionally including means for exposing the wrapped articles to heat for the purpose of hot sealing, shrinking or drying the sheet material and securely wrapping it about the articles, disposed along a portion of the conveyor means. The means for exposing advantageously includes a heat tunnel having a generally inverted U-shaped housing which defines a tunnel extending along a portion of the predetermined path. It is also desirable that the conveyor means includes a multiplicity of spaced-apart rollers operatively mounted thereon for moving the articles along the predetermined path.

The means for adhering may include spray means for applying a liquid spray to said web, adhesive means for applying adhesive to said web, or, most advantageously, an electrostatic generating means for generating opposite electric charges in said web and article, thereby causing the sheet to electrostatically adhere to the article.

In a preferred embodiment of the invention, the article feed means comprises a pivotable gate assembly movable between its first and second positions. The pivotable gate assembly desirably includes a gate pivot shaft rotatably supported on the machine above the infeed table, a pair of spaced-apart, generally parallel gate arms supported on the gate pivot shaft, and a pair of infeed gate rollers supported between the gate arms which serve as guide rollers for the sheet material and as an article restraint when the gate assembly is in its first position.

Most desirably the transverse cutting means comprises a parting wire carriage pivotably mounted on the gate assembly and a parting wire supported by the parting wire carriage. The parting wire is pivotable between a withdrawn position and a parting position, the latter of which generally coincides with the second position of the gate assembly and in which the predetermined portion of sheet material is severed from the web.

Certain of the foregoing and related objects are also attained in a method for wrapping generally cylindrical articles which includes the steps of successively feeding the articles by gravity along an inclined infeed table to an endless transport conveyor, successively stopping the articles at predetermined intervals as they roll forward on the infeed table toward the conveyor by means of a movable abutment, withdrawing sheet material from a web and guiding the leading edge thereof between the abutment means and the articles, adhering the leading edge of the sheet material to the article, and severing a predetermined portion of the material so that the predetermined portion may be wrapped around the article as it rolls forward toward the conveyor means.

BRIEF DESCRIPTION OF THE DRAWINGS

Further advantages and details can be gleaned from the drawings, wherein similar reference numerals denote similar elements throughout the several views. In the drawings.

DETAILED DESCRIPTION OF THE PREFERRED EMBODIMENTS

Figure 2:
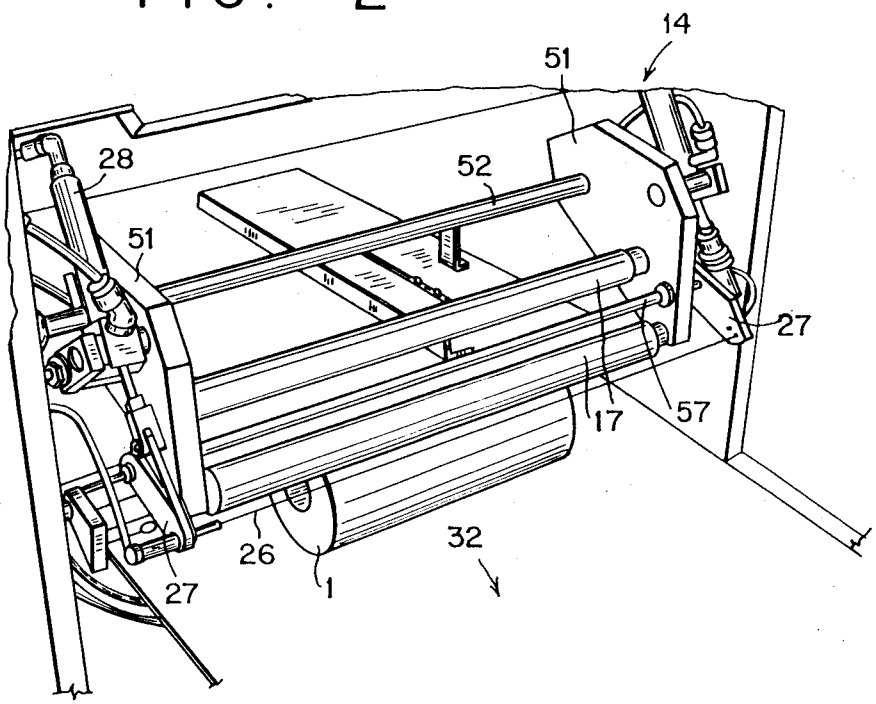
FIG. 2 is an enlarged, fragmentarily-illustrated reverse angle isometric view of the article infeed assembly of the machine shown in FIG. 1.
Figure 1:
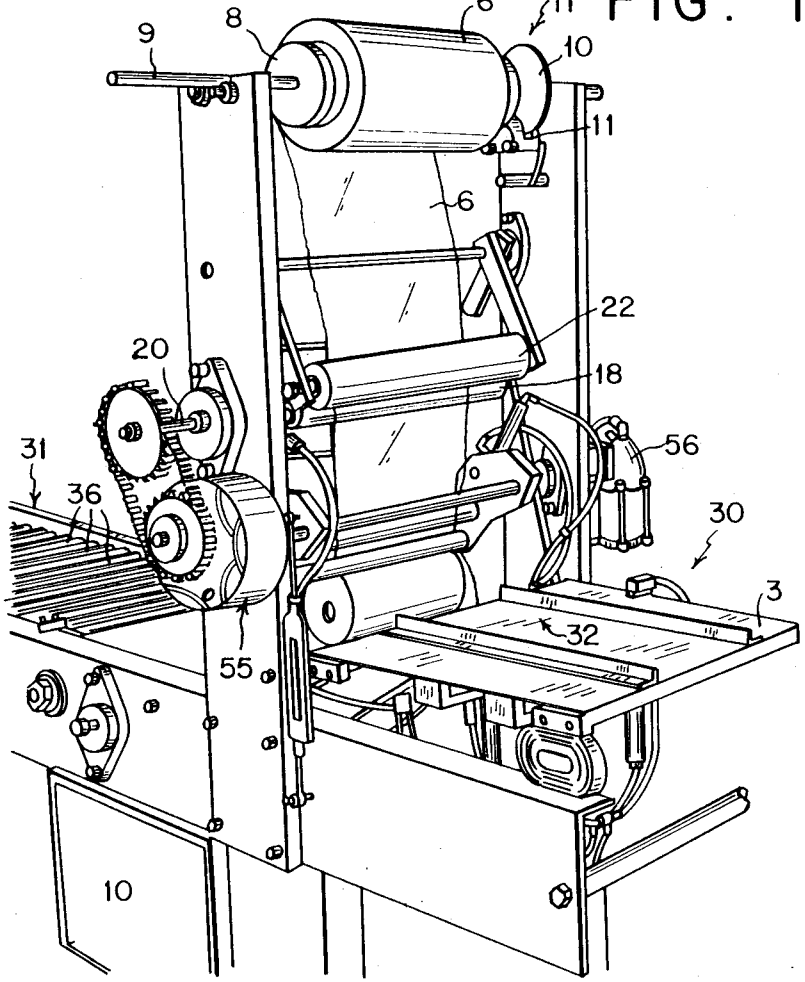
FIG. 1 is an isometric front, side and end view of a novel machine embodying the present invention.
Figure 3:
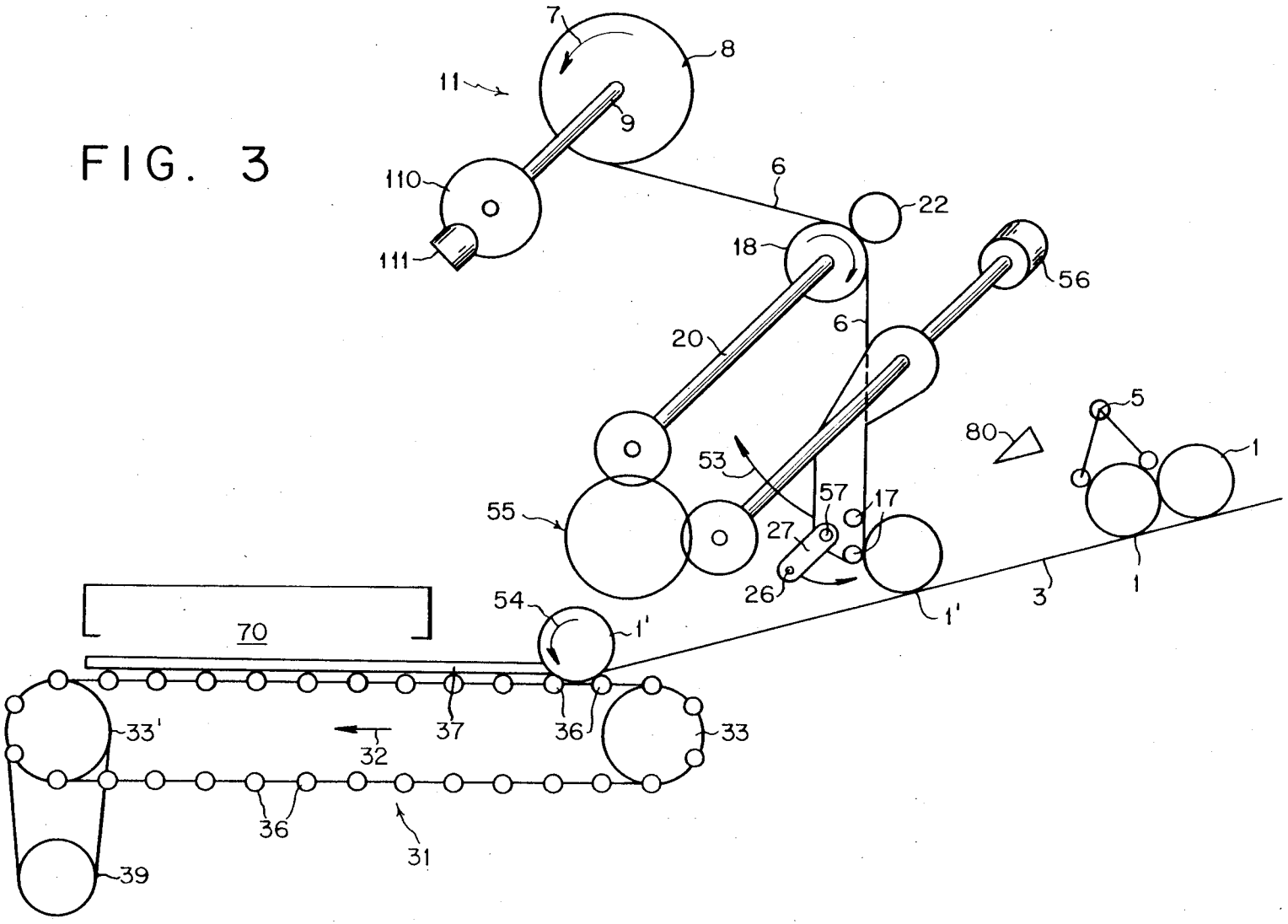
FIG. 3 is a schematic side elevational view of the machine.

Turning now in detail to the drawings, and, in particular FIGS. 1-3 thereof, therein illustrated is a novel wrapping machine especially intended for wrapping cylindrical articles which includes a machine base or table 10, which supports a web feeding assembly 11, an article infeed assembly 30, an article transport conveyor assembly 31, and a heat tunnel 70.

The basic construction and operation of the machine is perhaps best illustrated in the schematic drawing of FIG. 3. As can be seen therein, the web feeding assembly 11 includes an overwrap material mill roll 8 supported on a shaft 9, the free rotation of which is controlled by a mill roll brake consisting of a brake disk 110 and a brake caliper 111. The web 6 of overwrap material wound on mill roll 8, typically consists of a shrink-wrappable film, such as PVC, polyethylene or polyolefin. However, other materials, such as paper, could also be used. Upon unwinding of mill roll 8 in the direction of arrow 7, web 6 is feed between the overwrap material feed roller 18 and overwrap material pressure roller 22. Feed roller 18 is mounted on feed roller shaft 20 which, in turn, is controlled by a conventional proportional drive mechanism 55 (e.g., a helical gear reduction unit), as described in greater detail hereinafter.

Web 6 is then guided to the article infeed assembly 30. Article infeed assembly 30 includes an inclined infeed table or base 3 to allow the articles 1 to be fed by gravity to the machine. The infeed table 3 has a conventional, pneumatically-operated pivotable article escapement device 5 associated therewith for successively feeding the articles in timed relation to the feeding of the web 6, as described in greater detail hereinafter. Assembly 30 also includes an article infeed gate assembly 14 consisting of a pair of laterally-spaced apart, parallel gate arms 51, each of which is fixed on a gate pivot shaft 52 suspended above the article infeed base 3 and disposed perpendicular to the direction of travel 32 of the transport conveyor 31. The gate assembly 14 further includes a gate actuator 56 (e.g., a conventional rotary actuated pneumatic cylinder) acting on the gate pivot shaft 52 and capable of moving the infeed gate arms 51 through a pivotal motion described by the arrow 53. A pair of infeed gate rollers 17 is suspended between the gate arms 51 which act as overwrap material guide rollers as well as an article restraint.

The proportional drive mechanism 55 through which the gate pivot shaft 52, the gate actuator 56 and the material feed roller 18 are interconnected, serves to synchronize their actions. The proportional drive mechanism 55 preferably consists of a conventional helical gear reducer (e.g. Matel 221-D10 of Boston Gear/Incom International, Inc., Quincy, Mass. having a nominal 10:1 ratio. The reducer is installed "backwards" to produce an increase in output revolutions instead of a decrease. The input drive to the drive mechanism 55 is the rotation of infeed gate pivot shaft 52 driven by gate actuator 56. The drive mechanism 55, in turn, drives feed roller shaft 20 and feed roller 18. As can be appreciated, the greater the "throw" of crank of gate actuator 56, the greater (proportionally) the rotation of shaft 20 and feed roller 18. This, in turn, feeds a larger predetermined length of web 6 so as to accommodate larger diameter articles. Of course, the gear ratio and/or the gate actuator can be adjusted to the diameter of the article to ensure the feeding of an appropriate length of web material to wrap the article.

A parting wire 26 is supported by a pivoting parting wire carriage 27 is suspended between the gate arms 51 and fixed to a parting wire carriage pivot shaft 57. A parting wire carriage actuator 28 (e.g., a double-acting pneumatic cylinder) is coupled to shaft 57 to cause wire 27 to be pivoted in the direction of arrow 29 from a withdrawn or rest position (FIG. 3), to a parting position (shown in phantom view in FIGS. 4–6) and vice versa.

Figure 4:
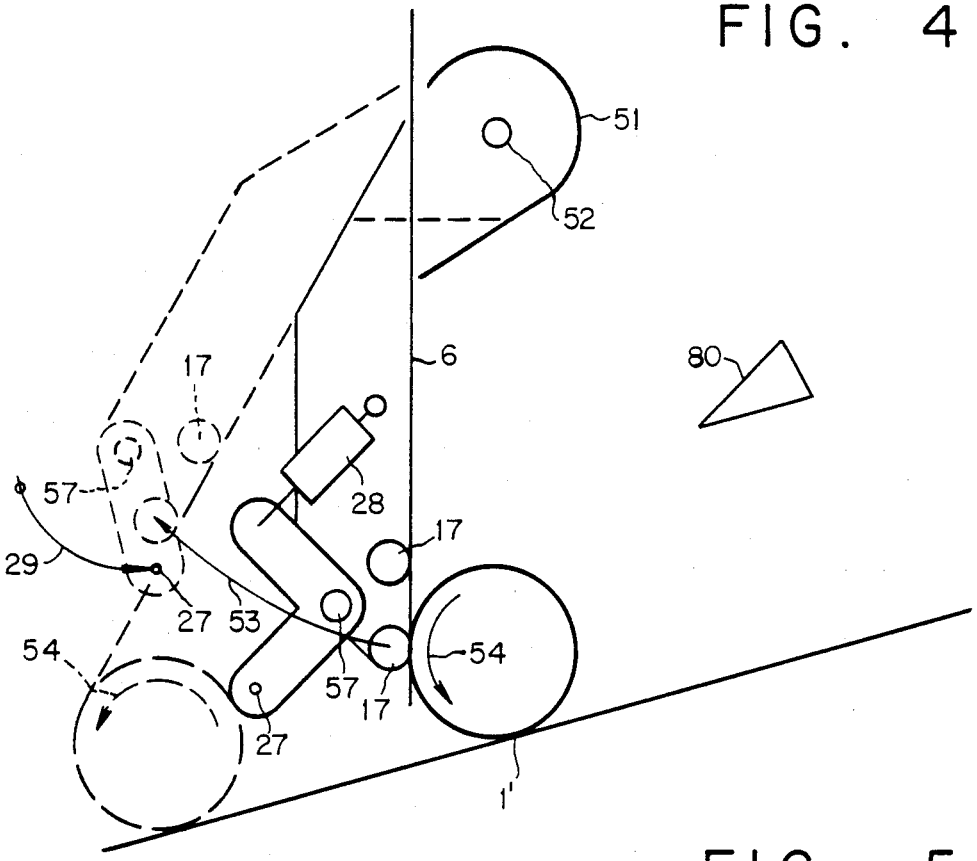
FIG. 4 is a fragmentarily-illustrated schematic view of the article infeed assembly of the machine, employing an atomizer for wetting the leading edge of the film, showing in full line, the position of the assembly following wetting of the film's leading edge and, in phantom line, the position of the assembly at the point at which the film is cut.
Figure 5:
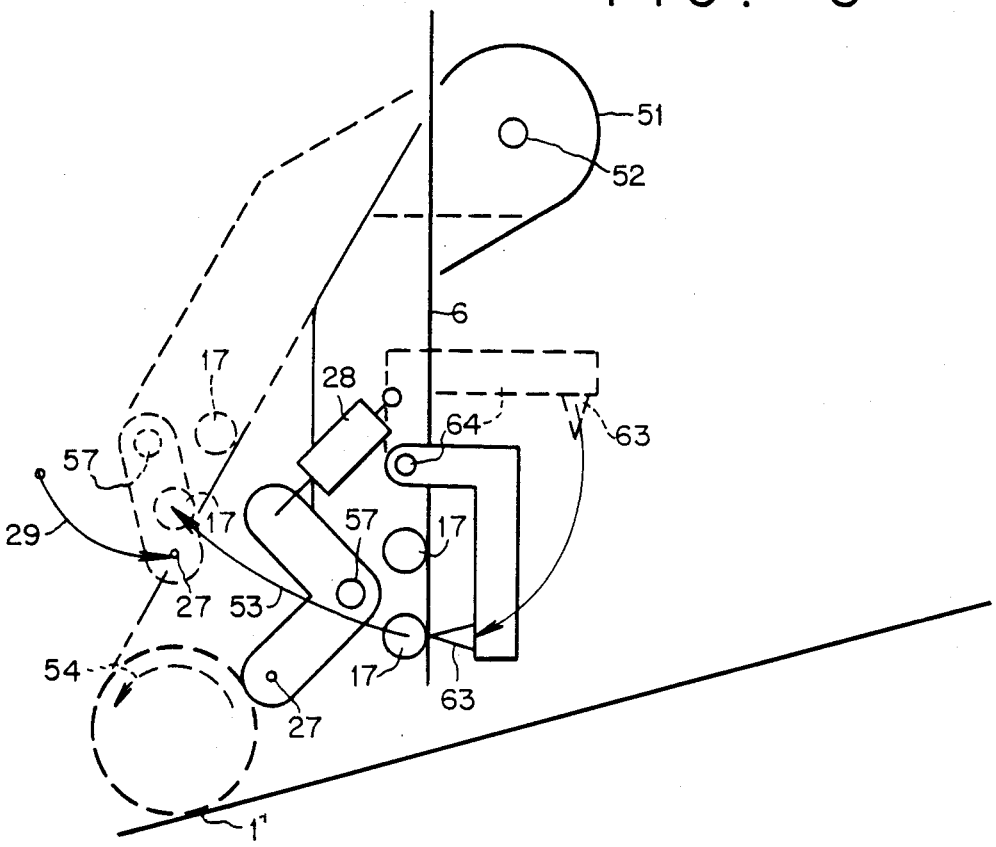
FIG. 5 is a view comparable to that of FIG. 4, but showing an alternate embodiment wherein an adhesive applicator is employed to apply adhesive to the leading edge of the overwrap film, showing in full line, the position of the assembly at time of adhesive application and, in phantom line, the position of the assembly at the point at which the film is cut.
Figure 6:
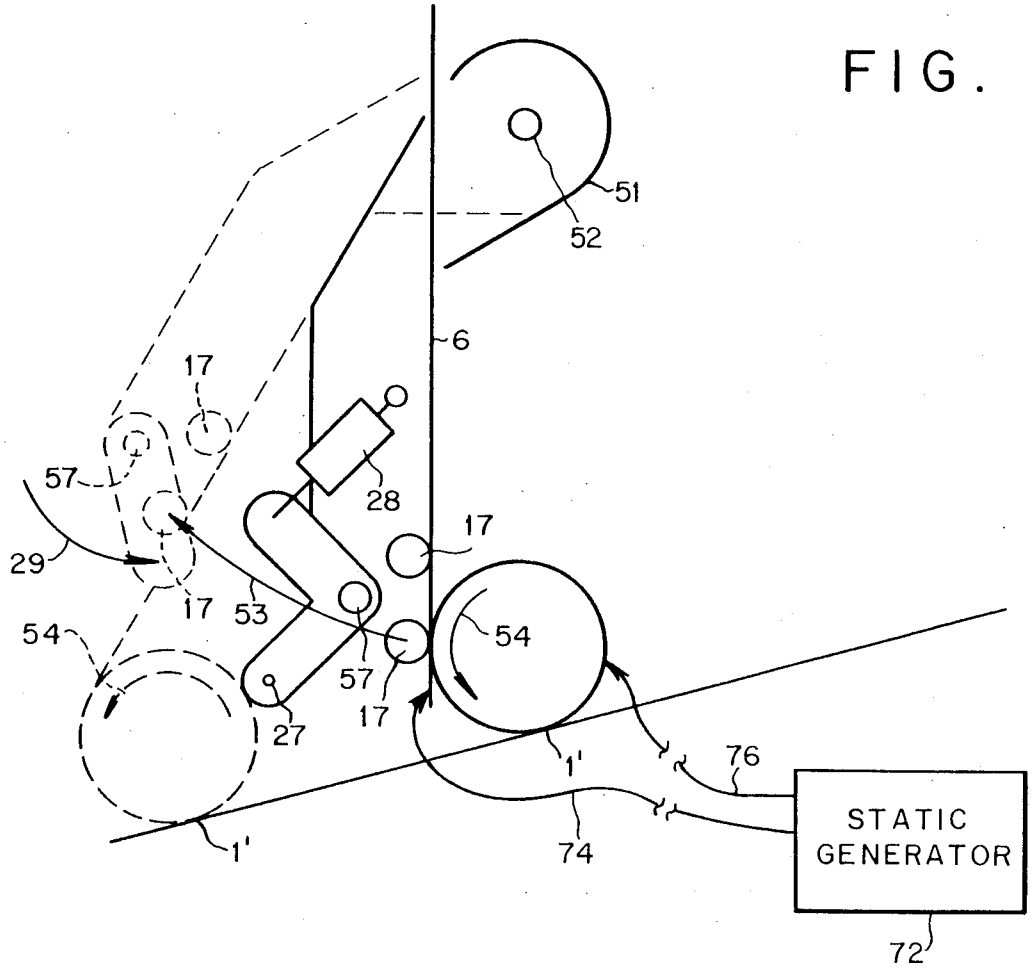
FIG. 6 is a view comparable to that of FIGS. 4 and 5, but showing a further embodiment wherein a static generator is employed to electrostatically adhere the leading edge of the overwrap film to the article, showing in full line, the position of the assembly at the time of application of the electrostatic charge and, in phantom line, the position of the assembly at the point at which the film is cut.

FIGS. 4,5 and 6 illustrate different overwrap material adhesion systems capable of adhering the leading edge of the overwrap material 6 to the article-in-process 1'. In FIG. 4, water atomized through nozzles 80 (one of which is shown) is directed onto the leading edge of the web 6 immediately prior to article 1' abutting and coming to rest against web 6, supported by gate roller 17. The water causes the leading edge of the web to adhere to article 1' so that after its release, it rotates under the action of gravity in the direction of arrow 54, entraining the "adhered" web 6 around its circumference as it rolls forward. For applications which require use of a heavier weight web, such as when processing a paper wrapper, water may not be an adequate adhesive. In such a case and as shown in FIG. 5, a conventional contact adhesive may be utilized and deposited by adhesive applicators 63 pivoting into and out of position by an appropriate and conventional pivot mechanism 64, operated, e.g., by a double-acting pneumatic cylinder (not shown). Alternatively, in cases where the use of either water or glue is not appropriate or desired, e.g., where the water or glue would damage the articles by leaving spots, etc. or mar its appearance, adhesion is effected as shown in FIG. 6, by the effect of static electricity generated by an electrostatic generator 72 having probes 74, 76, the construction and operation of which is well known by those skilled in the art. Probe 74 is disposed to contact web 6 adjacent its free leading edge and probe 76 is disposed to contact the article-in-transit 1'. Upon activation of the generator 72, probes 74,76 produce opposite electrical charges in web 6 and article 1', causing the web to electrostatically adhere to the article 1'.

Disposed underneath and adjacent the article infeed assembly 30, is an inlet end of the endless transport conveyor assembly 31, consisting of a pair of spaced-apart chain sprocket wheels 33, 33' on which are mounted chain driven, independently and freely rotatable, spaced-apart conveyor rollers 36. The upper run of the rollers 36 are disposed to engage guide rails 37 (one of which is shown) to cause rotation of the articles in the direction of arrow 54. Sprocket wheel 33 is mounted on sprocket shaft 34 for rotation therewith and sprocket wheel 33' is coupled via a belt to a constant drive motor 39. Since the cylindrical articles normally inteneded for use with the machine are rather long and therefore stable and since the articles always rotate in the same direction, it is not necessary to employ a stepping motor as employed in my earlier patent application Ser. No. 342,110, the subject matter of which is otherwise incorporated herein by reference thereto.

As seen in FIG. 3, a heating tunnel 70 is mounted on the machine table 10 above the discharge end of the transport conveyor 31. The heating tunnel 70 has a longitudinal passageway through which the wrapped articles are transported via the upper run of the roller conveyor 31. The construction and operation of the heat tunnel is also described in greater detail in the aforesaid prior patent application.

The various movements of the machine are controlled in timed sequence by a conventional programmable electronic sequence controller (not shown), as also described in the aforesaid prior patent application.

Turning now to the operation of the machine, a machine cycle begins with overwrap material 6 having been drawn, in the form of a web from the overwrap mill roll 8 in the direction indicated by the arrow 7, between the material feed roller 18 and pressure roller 22; behind, in the direction of travel 32 of the indexing transport conveyor 31, the infeed gate rollers 17, and stopping at the point shown in FIG. 3. An article 1 is held within the article escapement device 5, the article having been brought into this position by the action of gravity and the pivotal movement of article escapement device 5; the article infeed base 3 having been fixed at an appropriate angle of declination above the indexing transport conveyor 31. The material parting wire 26 and parting wire carriage 27 are withdrawn to an appropriate position by the carriage actuator 28 according to instructions previously programmed into the programmable electronic sequence controller.

Continuous and automatic machine operation proceeds, according to instructions previously programmed into the programmable electronic sequence controller as follows: The width of the overwrap material 6 where it crosses the infeed gate rollers 17 (FIG. 3), is made "adhesive" by one of the techniques previously described, as illustrated in FIGS. 4, 5 and 6. An article 1 being held in the escapement device 5 is released by the pivotal action thereof and rolls, by consequence of the action of gravity, to the position of article 1', shown in FIG. 3, coming to rest against the infeed gate roller 17. The overwrap material 6 now adheres to the article 1' resting against the infeed gate roller 17. The gate pivot actuation is initiated causing the infeed gate assembly 14 to withdraw, in the direction indicated by the arrow 53 in FIG. 3. The rotation of the gate pivot shaft 52, transmitted through the proportional drive mechanism 55 imparts motion to the material feed roller 18 thus drawing overwrap material 6 from the material mill roll 8, the length of which is determined by the mechanics of the proportional drive mechanism and the degree of travel 53 of the gate arms (also the degree of rotation of the gate pivot shaft 52); this obviously being variable depending on the size of the cylindrical articles to be wrapped. Simultaneously, the article 1' begins to roll down the infeed base 3 drawing the previously adhered overwrap material around its circumference as it rolls. This wrapping motion continues until the rotation of gate pivot shaft 52 and material feed roller 18 (interconnected through proportional drive mechanism 55) are caused to stop. The parting wire 26 and parting wire carriage 27 are now engaged via pneumatic cylinder 28 causing the pivoting of wire 27 in the direction of arrow 27 (FIGS. 4, 5 and 6) into the path of web 6 and causing the previously metered length of overwrap material to be parted from the web 6.

Consequently, the article-in-process 1', with the overwrap material 6 now wrapped around its circumference completes its descent and is deposited onto an adjacent pair of article support rollers 36 of the constantly driven transport conveyor 31. The parting wire 26 and parting wire carriage 27 are withdrawn to an appropriate position by the carriage actuator 28 while the article infeed gate assembly 14 returns to the ready position shown in FIG. 3. The overwrapped article-in-process 1' continues along the length of the transport conveyor 31 through the integral heat tunnel 70. The direction of rotation (arrow 54) of the article-in-process 1' does not change but continues in the same direction, both at the article infeed station and along the conveyor 36. The circulating hot air in the heat tunnel 70 heats the web 6, causing it to firmly adhere to the article 1'. The completed, overwrapped or shrink-wrapped articles are then fed to the discharge end of the transport conveyor 31, where an accumulation tray or automatic collection assembly is positioned (not shown).

As can be appreciated, various modifications may be made to the method and machine of the present invention, as will be apparent to those skilled in the art. For example, although the machine is specifically intended for wrapping facsimile paper, gift wrap, wallpaper, and the like, other generally cylindrical articles may also be wrapped by the present invention. In addition, although the machine is specifically intended for use with shrink-wrap film, such as PVC, polyethylene or polyolefin, which typically come in thicknesses of ¾ mil to 1¼ mil, it would be possible to wrap articles with heavier paper weight or other materials, if so desired.

Thus, while only several embodiments of the invention have been shown and described, it is obvious that there are many changes and modifications that may be made thereunto, without departing from the spirit and scope of the invention.

What is claimed is:

1. A machine for wrapping generally cylindrical articles comprising:

a supply reel rotatably mounted in said machine for unreeling a web of sheet material having a leading edge;

conveyor means for transporting said articles along a predetermined path;

an inclined infeed table for supplying said articles solely by means of a gravity feed to said conveyor means;

article feed and restraint means disposed adjacent said infeed table for successively feeding said articles to said conveyor means, movable between a first position, in which said means stops the gravity feed of said articles fed successively thereto, and a second position in which said articles are allowed to successively move by gravity forward for deposit on said conveyor means;

means for supplying the leading edge of said sheet material between said article feed means and said cylindrical articles;

means for successively adhering said leading edge of said sheet material to said articles; and transverse cutting means operatively acting with said article feed means for severing a predetermined portion of said sheet material so that said predetermined portion may be wrapped around each of said articles as they roll by gravity forward toward said conveyor means, said articles always rotating in the same direction as they move from said infeed table to said conveyor means and as said articles move along said conveyor means.

2. The machine according to claim 1, additionally including means for exposing the wrapped articles to heat for the purpose of hot sealing, shrinking or drying the sheet material and securely wrapping it about the articles, disposed along a portion of said conveyor means.

3. The machine according to claim 2, wherein said means for exposing comprises a heat tunnel having a generally inverted U-shaped housing which defines a tunnel extending along a portion of said predetermined path.

4. The machine according to claim 1, wherein said conveyor means including a multiplicity of spaced-apart rollers operatively mounted thereon for moving said articles along said predetermined path;

5. The machine according to claim 1, wherein said means for adhering includes spray means for applying a liquid spray to said web.

6. The machine according to claim 1, wherein said means for adhering includes adhesive means for applying adhesive to said web.

7. The machine according to claim 1, wherein said means for adhering includes electrostatic generating means for generating opposite electric charges in said web and article.

8. The machine according to claim 1, wherein said article feed means comprises a pivotable gate assembly movable between said first and second positions.

9. The machine according to claim 8, wherein said pivotable gate assembly includes a gate pivot shaft rotatably supported on said machine above said infeed table, a pair of spaced-apart, generally parallel gate arms supported on said gate pivot shaft, and a pair of infeed gate rollers supported between said gate arms which serve as guide rollers for said sheet material and as an article restraint when said gate assembly is in said first position.

10. The machine according to claim 8, wherein said transverse cutting means comprises a parting wire carriage pivotably mounted on said gate assembly and a parting wire supported by said parting wire carriage, said parting wire between pivotable between a withdrawn position and a parting position, the latter of which generally coincides with said second position of said gate assembly and in which the said predetermined portion is severed from said web of sheet material.

11. A method for wrapping generally cylindrical articles comprising the steps of:

successively feeding said articles solely by gravity along an inclined infeed table to an endless transport conveyor;

successively stopping said articles at predetermined intervals as they roll forward by gravity on said infeed table toward said conveyor by means of a movable abutment;

withdrawing sheet material from a web and guiding the leading edge thereof between said abutment and each successive article;

adhering the leading edge of said sheet material to said article; and severing a predetermined portion of said sheet material so that said predetermined portion may be wrapped around said article as it rolls forward by gravity toward said conveyor means, said articles always rotating in the same direction as they move from said infeed table to said conveyor means and as said articles move along said conveyor means.

12. A machine for wrapping generally cylindrical articles comprising:

a supply reel rotatably mounted in said machine for unreeling a web of sheet material having a leading edge;

transport means for transporting said articles along a predetermined path;

an inclined infeed table for supplying said articles solely by means of a gravity feed to said transport means;

article feed and restraint means disposed adjacent said infeed table for successively feeding said articles to said transport means, movable between a first position, in which said means stops the gravity feed of said articles fed successively thereto, and a second position in which said articles are allowed to successively move by gravity forward for deposit on said transport means;

means for supplying the leading edge of said sheet material between said article feed means and said cylindrical articles;

means for successively adhering said leading edge of said sheet material to said articles; and transverse cutting means operatively acting with said article feed means for severing a predetermined portion of said sheet material so that said predetermined portion may be wrapped around each of said articles as they roll by gravity forward toward said transport means, said articles always rotating in the same direction as they move from said infeed table to said transport means and as said articles move along said transport means.

13. A method for wrapping generally cylindrical articles comprising the steps of:

successively feeding said articles solely by gravity along an inclined infeed table to a transport means;

successively stopping said articles at predetermined intervals as they roll forward by gravity on said infeed table toward said transport means by means of a movable abutment;

withdrawing sheet material from a web and guiding the leading edge thereof between said abutment and each successive article;

adhering the leading edge of said sheet material to said article; and severing a predetermined portion of said sheet material so that said predetermined portion may be wrapped around said article as it rolls forward by gravity toward said transport means, said articles always rotating in the same direction as they move from said infeed table to said transport means and as said articles move along said transport means.

* * * * *